US008522504B2

(12) United States Patent
Ghali et al.

(10) Patent No.: US 8,522,504 B2
(45) Date of Patent: Sep. 3, 2013

(54) STUD SUPPORT SYSTEM FOR STRUCTURAL CONCRETE

(76) Inventors: Amin Ghali, Calgary (CA); Walter H. Dilger, Calgary (CA)

( * ) Notice: Subject to any disclaimer, the term of this patent is extended or adjusted under 35 U.S.C. 154(b) by 267 days.

(21) Appl. No.: 12/357,242

(22) Filed: Jan. 21, 2009

(65) Prior Publication Data

US 2009/0188201 A1 Jul. 30, 2009

(30) Foreign Application Priority Data

Jan. 28, 2008 (CA) ..... 2619333

(51) Int. Cl.
*E04C 5/16* (2006.01)

(52) U.S. Cl.
USPC ..... 52/719; 52/685; 52/688

(58) Field of Classification Search
USPC ..... 52/844, 719, 677, 681, 682, 685, 52/686, 688, 689, 333, 334, 340, 341, 252, 52/253, 258, 414
See application file for complete search history.

(56) References Cited

U.S. PATENT DOCUMENTS

| | | | | | |
|---|---|---|---|---|---|
| 667,871 | A * | 2/1901 | Ellinger | 52/250 |
| 3,401,497 | A * | 9/1968 | Gregory, Jr. et al. | 52/677 |
| 4,434,597 | A * | 3/1984 | Fischer | 52/681 |
| 4,612,747 | A * | 9/1986 | Andra et al. | 52/250 |
| 5,216,866 | A * | 6/1993 | Ekedal | 52/677 |
| 5,655,349 | A * | 8/1997 | Ghali et al. | 52/481.1 |
| 5,878,546 | A * | 3/1999 | Westover | 52/719 |
| 5,992,123 | A * | 11/1999 | Kies | 52/719 |
| 6,052,962 | A * | 4/2000 | Ghali et al. | 52/851 |
| 6,571,528 | B1 * | 6/2003 | Crump, Jr. | 52/699 |
| 2003/0115825 | A1 * | 6/2003 | Crump, Jr. | 52/704 |
| 2005/0108976 | A1 * | 5/2005 | Trangsrud | 52/677 |
| 2005/0217198 | A1 * | 10/2005 | Carraher et al. | 52/719 |

* cited by examiner

*Primary Examiner* — Jessica Laux
(74) *Attorney, Agent, or Firm* — Thomas E. Malyszko

(57) ABSTRACT

A reinforcing assembly for use in a structural concrete member, such as a slab, footing, raft foundation, beam, wall and column, has at least one reinforcing stud with an elongate stem an anchor head at one or both ends, and a support apparatus for positioning the stud in the concrete member. The apparatus has a rail and connector to mechanically secure the stem to the rail in a given spacing and orientation. The connector may be in to form of a clip member for mounting on the rail and for securing the stud thereto, or the connector may be formed integrally with the rail in the form of a recess along an edge of the rail. The rail typically positions a plurality of studs in the concrete member at a given location, direction and spacing.

1 Claim, 8 Drawing Sheets

STUD SUPPORT SYSTEM FOR STRUCTURAL CONCRETE

FIELD OF THE INVENTION

The present invention relates to a reinforcing system for structural concrete members such as slabs, footings, raft foundations, beams, walls and columns, and in particular to an apparatus for supporting reinforcing studs in such concrete members.

BACKGROUND OF THE INVENTION

In comparison to steel, concrete is a very weak material in tension. It reacts poorly to shear forces which create significant tensile forces, typically at inclined planes running between exterior surfaces of a reinforced concrete member.

Without shear reinforcement, shear failure in reinforced concrete members is brittle and occurs without much warning. A shear failure generally takes place by widening of an inclined crack which propagates from the inner part of the member to the outer faces or from the face of the concrete member which is in tension to the compression face. In comparison, a flexural failure of a reinforced concrete member is much more ductile and provides more warning prior to the failure of the flexural reinforcement because of the formation of cracks readily visible to the naked eye and the relatively large deflections of the concrete member.

Shear reinforcement in the form of stirrups and cross ties is provided to prevent shear failure. Stirrups resist tensile forces in reinforced concrete caused by: shearing in beams, corbels, bridge piers and walls; punching in slabs and walls; lateral expansion in columns; and splitting behind anchorages and below bearings at points of concentrated loads.

A stirrup is typically a reinforcing bar bent in a "U", "L" or closed box shape. The ends of the bar are usually in the form of hooks. A reinforcing bar, running in a direction perpendicular to the plane of the stirrup, is commonly lodged inside the hooks or the bends of the stirrups. Stirrups in a flat concrete slab, for example, contribute to shear resistance by developing tensile forces in the vertical legs of the stirrup. These tensile forces arise when the stirrup leg is intercepted by an inclined crack forming in the slab. However, such tensile forces cannot develop unless the stirrup leg is anchored effectively at both its ends to prevent it from being pulled out. This anchorage is provided by the bend of the stirrup at its corners or by the hooked ends combined with the bar lodged inside the hooks. A small slip in this anchorage reduces the effectiveness of the stirrup. The slip prevents the tension in the short stirrup leg from reaching its yield strength, and so the full capacity of the stirrup is not utilized.

Cross ties function in much the same way. A cross tie is a stirrup in the form of an "L" and is commonly provided with one hook at the upper end of the "L". A cross tie is sometimes made in the form of one straight bar with two hooks; but this is difficult to install.

Should the tension in a stirrup leg (or a cross tie) approach its yield strength, very high compressive stresses are developed and exerted on the concrete in contact with the inner face of the bend or hook. Despite of the commonly used radii for such bends (as required by the American Concrete Institute (ACI) Building Code and the Codes of other jurisdictions to limit the stress on concrete), these compressive stresses are sufficient to crush the concrete inside the bend, resulting in a measurable slip of the leg and dislocation of the hook. Such slip causes significant strain losses in the leg and diminishes the stirrup's capacity to prevent the widening of a crack. The loss of strain, and hence the loss of force resisted by the stirrup leg, is large because the stirrup leg tends to be short, particularly in slabs and walls.

The above noted slippage has been reported in the *Journal of American Concrete Institute* (Vol. 77, No. 1, January/February 1980, pp. 28-35, by F. Seible, A. Ghali and W. H. Dilger) and in *Bautechnik* (Vol. 42, October 1965, by F. Leonhardt and R. Walther (in German)).

Use of stirrups and cross ties also presents other problems: they are difficult to form properly; installing flexural reinforcement through rows of stirrups, often required in two orthogonal directions, is extremely difficult and time consuming; and stirrup congestion in high shear locations makes it difficult to pour and vibrate concrete. Consequently, given a choice, many designers would prefer omitting closed stirrups in reinforced concrete design.

Solutions to some of the above-noted problems associated with stirrups and cross ties have been proposed by the present inventors in Canadian Patent 1,085,642 issued Sep. 16, 1980 and U.S. Pat. No. 4,406,103 issued Sep. 27, 1983, which describe stud shear reinforcement for flat concrete slabs. One form of this stud shear reinforcement comprises a plurality of spaced, substantially vertical steel rods fixed at the bottom to a flat supporting base plate. The top of each rod has an anchor head to provide anchorage of the reinforcement within the concrete slab. The anchor head is mechanically attached to the stem of the stud, usually by forging, cold forming or welding. This reinforcement has enjoyed wide acceptance and use in the construction industry.

A vertical stud of the prior patents which crosses a crack in a slab will prevent the crack from widening provided that no slip occurs, at least until the yield stress of the stud is reached. To avoid slippage, the anchor head must be sufficiently large so that the concrete behind (i.e. on the stem side of) the head does not crush while the tensile force in the stem of the stud remains below its yield strength. On the other hand, the size of the anchor head should not be so large as to make forging impossible or too costly, it should not complicate the placement of flexural reinforcement, nor should it interfere too much with the casting of concrete in congested areas. It has been generally accepted, and as allowed by the Canadian Standard and the American Concrete Institute (ACI) Building Code and the Codes of other jurisdictions, that an anchor head should have an area about 10 times the cross-section area of the intermediate stem of the stud to avoid crushing of concrete, depending on the quality and strength of the concrete used. In some circumstances the size of the anchor head necessary to avoid crushing may result in a clearance between adjacent anchor heads which is rather tight, making arrangement of the longitudinal bars needlessly inconvenient and difficult.

The studs of U.S. Pat. No. 4,406,103 and Canadian patent 1,085,642 are welded at a preset spacing to the elongate base plate prior to placement in the concrete formwork. Such welding is rather expensive and slows production time of the stud shear reinforcement. The welding process is also difficult to do on-site, and hence the stud shear reinforcement is always produced off-site in a shop.

U.S. Pat. No. 5,655,349 and Canadian Patent 2,165,848 by the present inventors describe another form of this stud shear reinforcement wherein an elongate support element in the form of a U-shaped trough receives and retains with a clamping force one end of a plurality of studs in a spaced relationship. For corrosion and fire protection all concrete design codes specify a minimum distance, referred to as concrete cover, between the surface of concrete members and the reinforcement. Unfortunately, the support element (the trough) in U.S. Pat. No. 5,655,349 and Canadian patent 2,165,848 is more vulnerable to corrosion than the studs because it is closer to one face of the concrete member. Thus, to maintain the concrete cover specified in design codes or standards for corrosion and fire protection, the studs must be shorter and consequently become less effective.

Furthermore, when the trough is placed horizontally, it creates a shallow space between the formwork and the trough where compaction of poured concrete is difficult and may result in voids below the trough due to entrapment of air. This contributes to the vulnerability of corrosion of the trough.

Another shortcoming of the above-noted prior art is that the stems of the studs of U.S. Pat. No. 4,406,103 and Canadian patent No. 1,085,642 must be perpendicular to the base plate. Similarly, the stems of the studs of U.S. Pat. No. 5,655,349 and Canadian patent No. 2,165,848 must be perpendicular to the support element (the trough). However, in some applications it would be advantageous to place studs with stems inclined to the base plate or support element to control cracks more efficiently.

What is therefore desired is a reinforcing system which overcomes the shortcomings of the prior reinforcing systems. Such novel system should be robust and easy to assemble mechanically by unskilled labor. Assembly should be possible in the shop or at the construction site. The overall length of the headed studs in the novel system should be equal to the thickness of the member less the concrete cover specified by the applicable code, when oriented parallel to said thickness. In this way concrete confined between the opposed heads of a given stud is at a maximum. The apparatus supporting the studs should be spaced away from the surface of the concrete member to make it less vulnerable to corrosion and to avoid the earlier-noted difficulty of concrete compaction. Furthermore, the novel system should permit orientation of the stems of the studs not only at a 90° angle to the support apparatus but at other chosen angles.

SUMMARY OF THE PRESENT INVENTION

In one aspect the invention provides a robust reinforcing system for use in structural concrete members. The system has at least one, but preferrably two or more steel studs, each stud having an elongate stem with anchor head at one or both ends; and a support apparatus having a support element in the form of a rail mechanically holding firmly the studs at a specified spacing and orientation. The angle between the rail and the stems is 90°, 45°, or other.

During construction, the apparatus of the present invention positions the studs in the formwork of the concrete member in the appropriate location, direction and spacing, as specified by the designer, until the concrete is poured. The concrete member typically has reinforcing bars running parallel and close to its top and bottom faces. The placement of the stud assembly in the formwork follows the placement of the bottom flexural reinforcement; and the top flexural reinforcement is placed last. In a preferred embodiment the stems of the studs are connected firmly to the rail by means of connectors. In a concrete structural member that is horizontal or inclined, the rail is situated sufficiently high above the bottom heads of the studs so that it does not interfere with the bottom reinforcement. The advantage of the invention is the ease of installation with minimal interference with the bottom and/or the top reinforcement. If in a rare occasion the lower head of a stud interferes with a bottom reinforcing bar, the bar, rather than the stud, should be shifted slightly to avoid the interference. Such shift of a bar should have no effect on the flexural strength of the member. The main advantage of the novel support system is the ease of mechanical assembly of its components. The components can be packaged and transported to the site without prior assembly. Alternatively, assembly can be performed in the factory before transport to the construction site.

The headed studs are most effective when the heads are situated as close as possible to the faces of the structural member. The distance between the outer face of the anchor head and the concrete member's surface should be equal to the minimum concrete cover specified by applicable codes. The rail of the present invention connects the stud stems, rather than the heads, permitting the overall length of the studs to be at a maximum, thus optimizing the effectiveness of the studs.

In the preferred embodiment of the invention the connectors which provide the mechanical connection between the stems of the studs and the rail have slots of appropriate shapes to receive and firmly hold the stems by pressing against the stems of the studs or the rail. The connector is preferably made of plastic, but other suitable materials may also be used.

In another embodiment of the invention the connector is defined by slots in the rail forming a part of a cylindrical surface into which the stems of the studs are pressed to fit snugly.

The angle between the axes of the slot of the rail and the stem of the stud is preferably 90°, but may be 45°, or other angle suitable to the orientation of the concrete member.

The invention can also comprise a single stud and a rail. In this case the ends of the rail have to be supported and tied (by wire) to conventional bars in the concrete member, or to other support means.

Hence, in one aspect the invention provides a reinforcing assembly for a structural concrete member comprising:

at least one reinforcing stud having an elongate stem and a generally planar anchor head at least at one end of said stem for anchoring said stud in said concrete member; and a support apparatus for positioning said stud in said concrete member, said apparatus having at least one elongate rail and a connection means which serves to secure said stem to said rail in a given orientation.

In another aspect the invention provides an apparatus for supporting a stud in a structural concrete member, said stud having an elongate stem and an anchor head at least at one end thereof, said apparatus comprising an elongate rail for positioning said stud in said concrete member, and a connector for securing said stem to said rail in a given orientation.

BRIEF DESCRIPTION OF THE DRAWINGS

Embodiments of the invention will now be described, by way of example only, with reference to the accompanying drawings, wherein:

FIG. 8(*b*) is a cross-section along line 8-8 in FIG. 8(*a*) showing one variant of the rail wherein the recess holds the stem generally perpendicular to the rail;

FIG. 8(*c*) is a cross-section along line 8-8 in FIG. 8(*a*) showing another variant of the rail wherein the recess holds the stem inclined to the rail;

FIGS. 9 to 15 show some of the many uses of the stud support system, with reference to the first embodiment of the present invention by way of example, wherein FIG. 9 is a vertical sectional view in a horizontal concrete slab at a vertical concrete column employing the present system as reinforcement against punching shear;

FIG. 10 is a plan view along line 10-10 of FIG. 9 of several rows of the stud support system as it would be arranged in formwork before casting of the concrete slab in the vicinity of the supporting column;

FIG. 11(*a*) is a horizontal sectional view through a vertical reinforced concrete column showing the stud support system employed as cross-ties for confinement of the concrete;

FIG. 11(*b*) is a horizontal sectional view similar to FIG. 11(*a*) through another vertical column also showing the stud support system employed as cross ties for confinement of the concrete;

FIG. 12 is a horizontal sectional view in a vertical reinforced concrete wall for resisting lateral forces due to wind or earthquake, such as a shear wall, showing the stud support system employed as cross ties at the boundaries of the wall;

FIG. 13 is a vertical sectional view through a concrete corbel showing the stud support system employed as flexural reinforcement;

FIG. 14 is a vertical sectional elevation through the dapped end of horizontal concrete beam showing the stud support system employed to resist tension in an inclined direction;

FIG. 15 is a vertical sectional elevation through the dapped end of a horizontal concrete beam showing the stud support system supporting studs horizontally having a head at only one end of each stem; and, FIG. 16 is an elevational cross section of the horizontal concrete member of FIG. 6 at its connection with a column or a wall, showing an embodiment of a stud support system wherein a support apparatus has a rail and connectors supporting inclined studs, with one or more studs bent horizontally to anchor inside the column or the wall.

DESCRIPTION OF PREFERRED EMBODIMENTS

Figure 1:
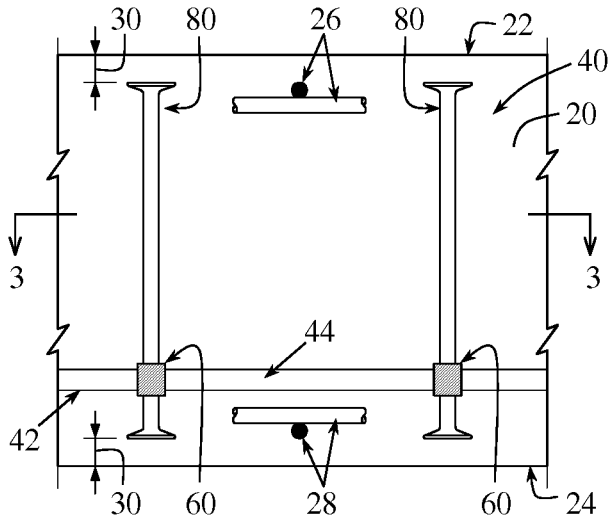
FIG. 1 is an elevational cross section of a horizontal concrete member, such as a slab or beam, showing a first embodiment of a stud support system wherein a support apparatus has a rail and connectors supporting studs vertically in the concrete member.

The figures show a stud support system (generally designated by the reference numeral 40), or reinforcing assembly, of the present invention for use when constructing, or "pouring", a structural concrete member 20. The system 40 has one or more reinforcing studs 80, some versions of which are also know as "shear studs", that are positioned within the concrete member 20 using a novel support apparatus 42. The support apparatus has an elongate rail 44 with a connection means that serves to mechanically secure the stud's stem 82 to the rail in a given orientation relative to the rail, and hence relative to the concrete member when the rail is placed in the formwork of the concrete member to be poured. In one version of the support apparatus, the connection means takes the form of a connector 60 mountable to the rail, and in another version the connection means takes the form of a slot along an edge of the rail. In essence, the connection means provides for positioning of the studs relative to the rail in at least three degrees of freedom by spacing the studs along the rail and orienting each stud relative to the rail in a given direction (i.e. angle of stem to rail) and location (i.e. longitudinal/axial location of stem to rail). The many uses and advantages of the present system will be further described below.

Referring first to FIG. 1, a typical concrete member 20 suitable for the system of this invention has a first, or top, face 22 and an opposed second, or bottom, face 24. The member 20, which can be a conventional reinforced concrete slab or beam for illustrative purposes, has flexural reinforcement near the top face 22 in the form of embedded reinforcing bars 26 running in one or two orthogonal directions, and likewise near the bottom face 24 face in the form of embedded reinforcing bars 28 running in two orthogonal directions. This top and bottom flexural reinforcement should each have a minimum clear concrete cover 30 as required by applicable codes to protect it from corrosion and the like.

It is noted that terms such as "top" or "bottom", "horizontal" or "vertical", "upper", "lower", etc. may be used for identifying certain features of the present system relative to a certain type of concrete member or the like, or for a typical orientation of such concrete member. The use of these terms is not intended to limit the present system's use or orientation. Further, when describing the invention, all terms not defined herein have their common art-recognized meaning.

Figure 2:
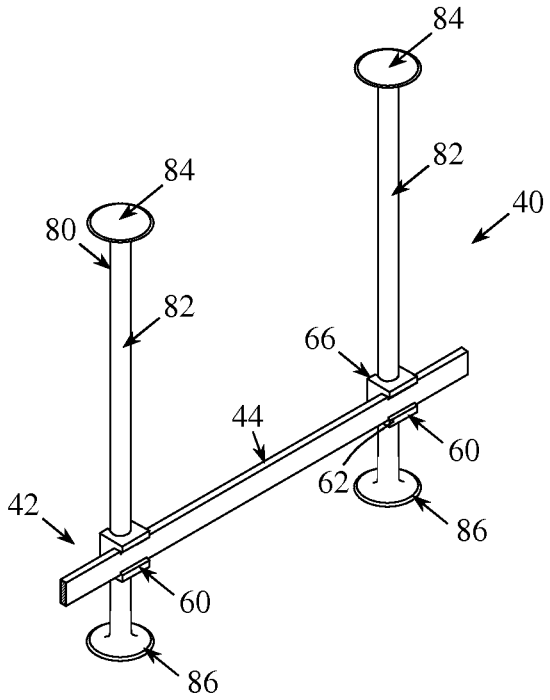
FIG. 2 is a perspective view of the stud support system of FIG. 1, omitting the concrete member.

Each of the studs 80 shown in FIGS. 1 and 2 are of typical construction, namely an elongate cylindrical stem 82 capped at the first (top) and second (bottom) ends with a planar anchor head 84 and 86, respectively. It should be appreciated that single-headed studs may be employed as well, although less commonly, depending on the type of concrete member being built and its intended use, such as the one shown in FIG. 15. However, in the FIG. 1 embodiment a two headed stud is preferred so that the heads 84, 86 can anchor the stud adjacent the respective top and bottom faces 22, 24. It will be understood that "adjacent" means that the stud's head is not at, but rather proximate to the concrete member's face, and that at least the requisite clear cover 30 is provided between the head and the face. As will be appreciated, the present invention allows the stem heads to be placed at the outer permissible limits of the concrete member, thus allowing the headed studs to have the maximum volume of concrete confined between the opposed heads.

Referring now specifically to FIGS. 1 to 5, a first embodiment of the support apparatus 42 is shown having an elongate rail 44 and connectors 60 mounted thereon at spaced intervals. The rail in this embodiment has a rectangular cross-sectional profile, although other profiles may also be suitable (such as circular or channel shape) for manufacturing, assembly or other reasons. The connector 60, which can also be referred to as a fastener or clip member, has a first portion 62 forming a c-shaped slot 64 which mounts onto the rail and secures the connector thereto. The slot's shape allows the connector to be clipped/snapped on at a desired location along the rail, and to be pried off the rail if need be, without having to slide the connector to and from the end of the rail. The slot 64 is preferrably dimensioned to fit very snugly on the rail, and thus prevent unwanted sliding therealong such as when placed in the formwork of the concrete member or during transport to the worksite (if the system is pre-assembled in the shop). A second portion 66 extends from the connector's first portion 62 to define opposed arms 68 forming a channel 70 for operatively engaging a stud stem 82. The channel is of suitable shape and dimension to allow the stem to be press fitted, or snapped, thereinto to firmly hold, or secure, the stem in place to prevent slippage. However, the channel's hold on the stem should provide for some axial movement therethrough upon exertion of given force, such as with a hammer hit on the stem's head, to change the axial location of the stud heads from the connector and rail if required. As with the slot 64, the channel 70 shape allows the stud to be pried off the connector if need be, but this action is not desired as it may damage the channel and its ability to again properly receive a stud stem. Where a channel is excessivly damaged, the entire connector may have to be replaced from the rail.

In the first embodiment, the connector's slot 64 in the first portion 62 is oriented relative to the channel 70 of the second portion 66 to position the stud stem 82 generally perpendicularly to the rail 44. Hence, the assembled stud reinforcing system 40 of the first embodiment is illustrated in FIG. 2, and the system installed in the concrete member appears in FIG. 1. The preferred sequence of installation of the reinforcement in the formwork of the concrete member in FIG. 1 is to first place the bottom flexural reinforcement 28 adjacent the bottom face 24 (providing the requisite clear cover 30), then to place the assembled components 40 of the present invention, and finally to place the top flexural reinforcement 26 adjacent the top face 22. The connectors 60 should be located on the stems 82 at a level sufficiently high to not interfere with the bottom reinforcing bars. With the rail 44 placed parallel to each of the faces 22, 24, the studs 80 are therefore oriented perpendicularly to those faces. Since the connectors 60 engage only one end of the stems, and do not engage nor extend beyond either of the heads 84, 86, then the longest possible perpedicularly-oriented stud can be used, as only twice the clear cover 30 need only be subtracted from the thickness of the concrete member to determine the permissible stud length.

Figure 3:
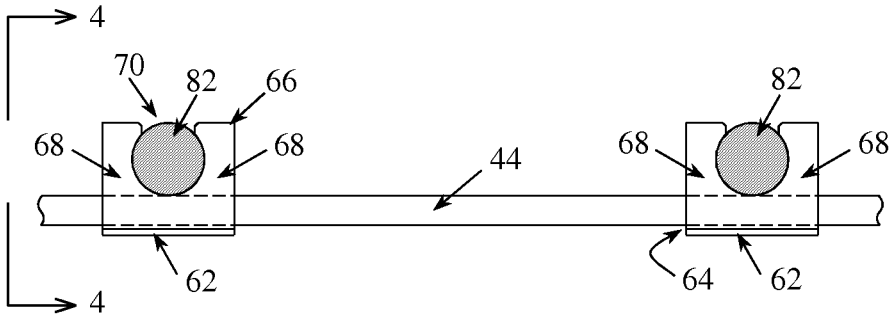
FIG. 3 is a horizontal sectional (plan) view along line 3-3 of the stud support system in FIG. 1, omitting the concrete member.
Figure 3A:
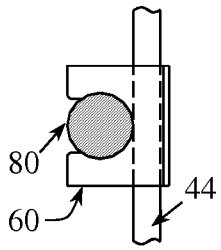
FIG. 3*a* shows another version of the FIG. 3 embodiment where only one stud is connected to a rail.
Figure 4:
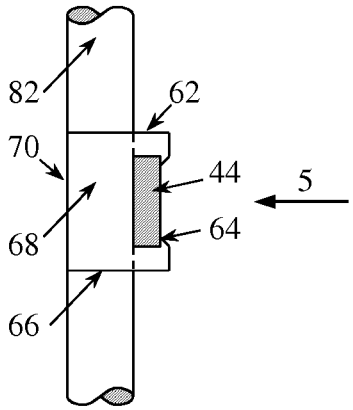
FIG. 4 is a vertical sectional view along line 4-4 in FIG. 3 showing the first embodiment of a connector on a rail supporting the stem of a stud.
Figure 5:
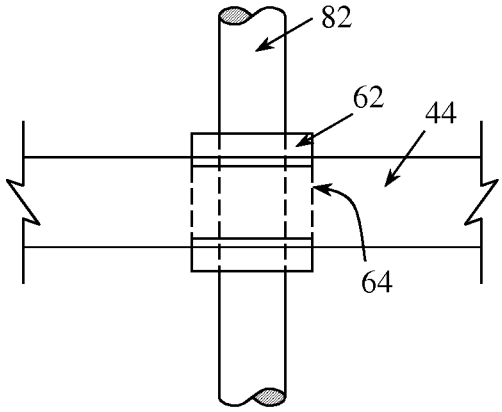
FIG. 5 is an elevational side view in the direction of arrow 5 in FIG. 4.

Although a rail with multiple studs attached thereto is expected to be most frequently employed, the present system can also employ as few as one stud 80 on a rail 44 with one connector 60, as shown in FIG. 3*a*. In this case the ends of the rail have to be supported and tied (by wire) to conventional bars in the concrete member, or to other support means.

Figure 6:
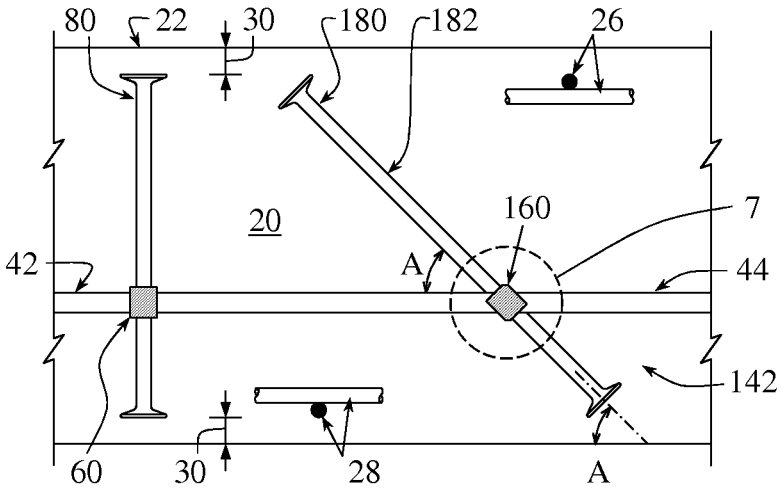
FIG. 6 is an elevational cross section of a horizontal concrete member similar to FIG. 1, but showing a second embodiment of a stud support system wherein a support apparatus has a rail and connectors supporting inclined studs, or a combination of inclined and vertical studs, in the concrete member.
Figure 7:
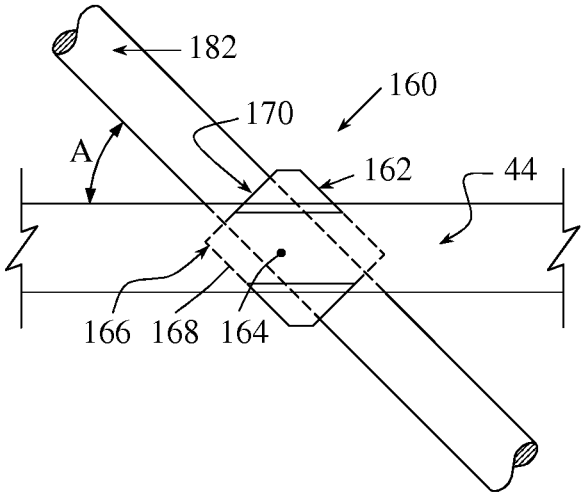
FIG. 7 shows the circled area indicated by numeral 7 in FIG. 6, which is a close-up of the rail and connector supporting the stem of the stud at an incline to the rail.

FIGS. 6 and 7 show a second embodiment of the invention located in the same type of concrete member 20 as in FIG. 1, but the support apparatus 142 supports the studs 180 at an incline within the concrete member. This allows the use of longer studs than the perpendicularly oriented studs 80 of FIG. 1. For each of the various embodiments disclosed herein, the same reference numerals will be used for the same or substantially similar components. The same rail 44 is employed in the second embodiment, and the connector 160 has the same basic structure as the earlier connector 60, namely a first portion 162 forming a c-shaped slot 164 which mounts onto the rail and secures the connector thereto, and a second portion 166 which extends from the first portion 162 to define opposed arm 168 forming a channel 170 for receiving the stud stem 182. However, the second portion 166, and in particular the arms 168 and channel 170, are inclined relative to the first portion 162 at an angle A which is not 90 degrees as in the FIG. 1 embodiment, but at another acute angle suitable to the concrete member's design. One suitable incline would be at an angle A of 45 degrees, to optimally intersect certain diagonal cracks in the concrete member. Hence, when the rail 44 is placed parallel to each of the faces 22, 24, the studs 180 are also oriented at the same angle A to those faces.

Figure 8A:
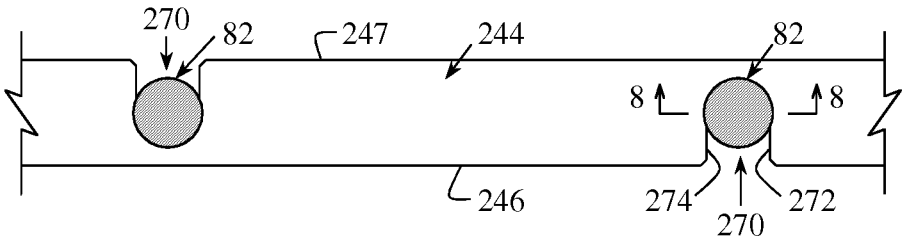
FIG. 8(*a*) is a plan view of a third embodiment of a stud support system showing a rail for supporting the stud stems, wherein recesses in the rail function as connectors for the stems.
Figure 8B:
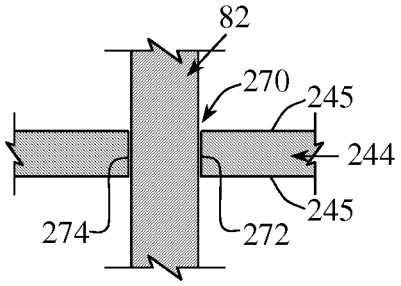
Figure 8C:
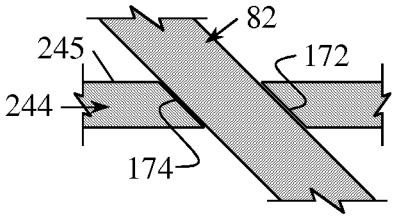

FIGS. 8(*a*) to 8(*c*) show a third embodiment of the stud support system wherein the connection means is integral with the rail 244, omitting the need for a connector that clips onto the rail. The connection means is defined by at least one u-shaped channel, or recess, 270 that is formed along a first edge 246 of the rail 244. The recess is of a size and shape that snugly fits the cross sectional shape of a stud's stem 82. The stem is secured to the rail by pressing the stem sequentially against one side 272 and the other side 274 of the recess until it is firmly engaged therewith, without the need of additional fasteners. FIG. 8(*b*) shows one variant of the recess in cross-section where its sides 272, 274 are cut at right angles to the rail's top and bottom surfaces 245, to retain the stem 82 generally perpendicularly to the rail. FIG. 8(*c*) shows another variant of the recess where the sides 172, 174 are formed at an incline (i.e. other than at a right angle) to the rail's top and bottom surfaces to retain the stem inclined to the rail. Although a plurality of recesses 270 may be spaced along the same edge 246 of the rail, it is preferred to provide a staggered pattern as shown in FIG. 8(*a*) where the recesses are alternatingly located along the opposed edges 246, 247 of the rail. The staggered pattern helps avoid bowing of the rail when manufactured, particularly of steel rails, and upon assembly with the studs.

It is noted that the rails and connectors are preferrebly made of steel or plastic, although other suitable materials (and preferably non-corrosive for certain applications) may also be used.

Figure 9:
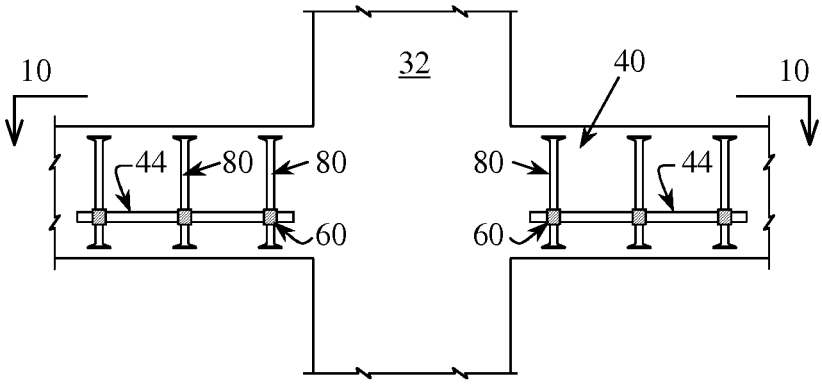
Figure 10:
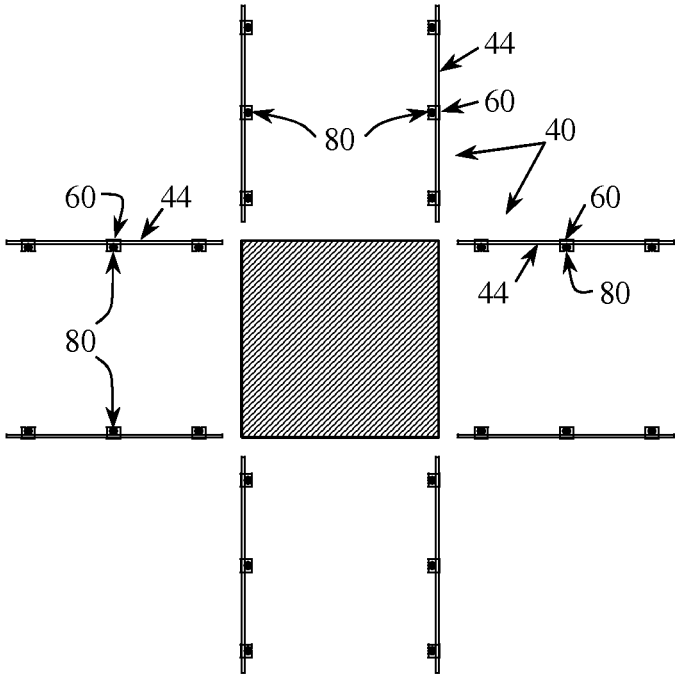

FIGS. 9 to 15 show some of the many uses of the stud support system, with reference to the first embodiment of FIG. 1 by way of example. FIG. 9 shows a horizontal concrete slab 20*a* at a vertical concrete column 32 employing the stud support system 40 as reinforcement against punching shear without beams or enlargement of the column head. FIG. 10 shows in plan view the several rows of the stud support system of FIG. 9 as they would be arranged in formwork in relation to the column before casting of the concrete slab.

Figure 11A:
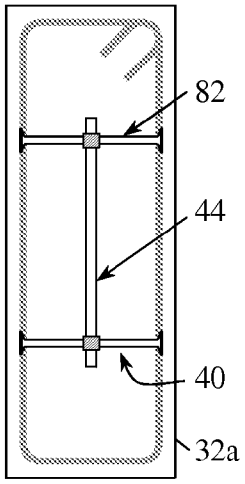
Figure 11B:
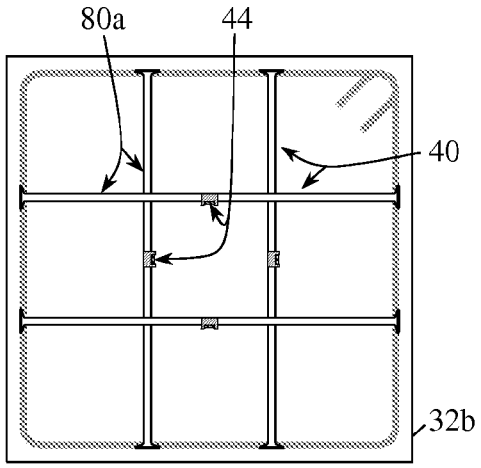

FIG. 11(*a*) shows a rectangular reinforced concrete column 32*a* where the stud support system 40 is employed as cross-ties for confinement of the concrete. It illustrates that the rail 44 may be attached anywhere along the stud's stem 82, and not necessarily near the stud heads as in the earlier figures. FIG. 11(*b*) is a view similar to FIG. 11(*a*) through a square vertical column 32*b* also showing the stud support system 40 using longer studs 80*a* employed as cross ties for confinement of the concrete. In column 32*a* the rail 44 runs in a horizontal direction, and in column 32*b* the rails 44 run vertically.

Figure 12:
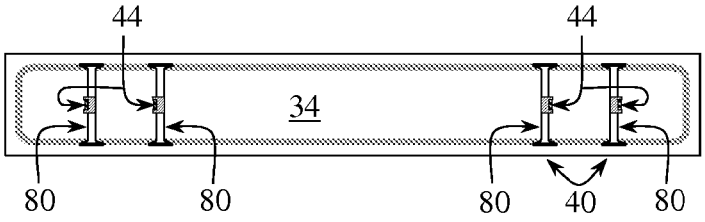

FIG. 12 shows a vertical reinforced concrete wall 34 for resisting lateral forces due to wind or earthquake, such as a shear wall, showing two parallel rows of the stud support system 40 employed as cross ties at the boundaries (ie. each end) of the wall. In this application the system 40 confines the concrete at the boundaries of the wall to to resist high compressive stresses. The rails 44 run in a vertical direction with the studs 80 in each row spaced vertically above one other.

Figure 13:
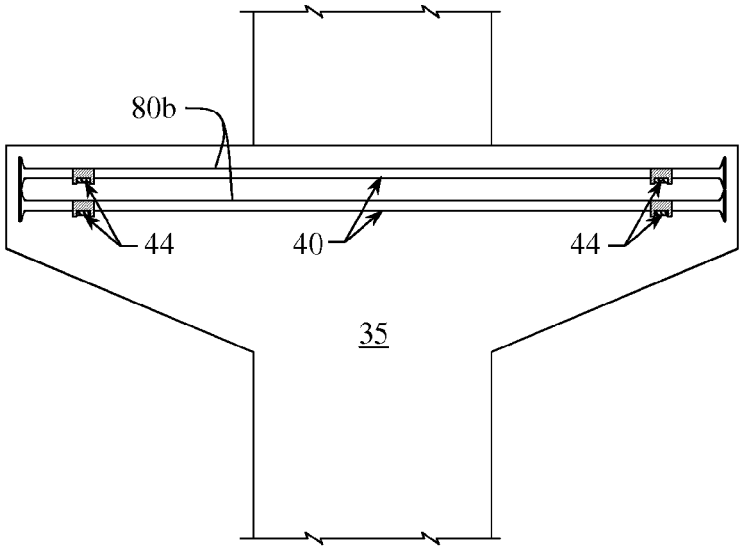

In FIG. 13 a concrete corbel 35 shows the stud support system 40 employed as flexural reinforcement to resist tension forces near its top face. Two rows of long stemmed studs 80*b* are employed, but because of their length the studs in each row are connected with two spaced rails 44 that run horizontally, namely in a direction perpendicular to the page of FIG. 13. Hence, more than one rail may be employed in a given support apparatus, as required.

Figure 14:
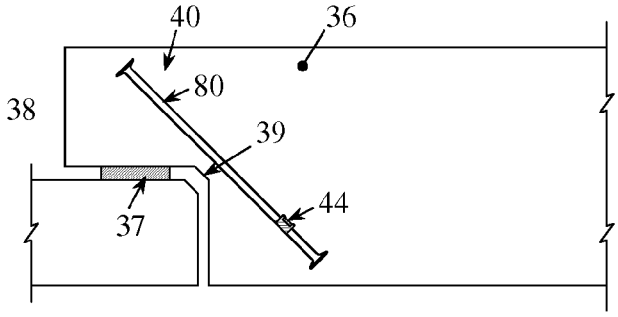

FIG. 14 shows a dapped end of precast horizontal concrete beam 36 where the stud support system 40 is employed to resist tension in an inclined direction. A part of the depth of the beam is blocked out to provide room for a pad support 37, and so the beam end of this shape is referred to a dapped end 38. The present system 40 is used to orient the studs 80 in an inclined direction to intercept the crack that is likely to form at the re-entrant corner 39 and to propagate in a direction perpendicular to the stud. In this application the number of studs can be 1 to 3 (or more) with one rail 44 running perpendicular to the beam's face as shown.

Figure 15:
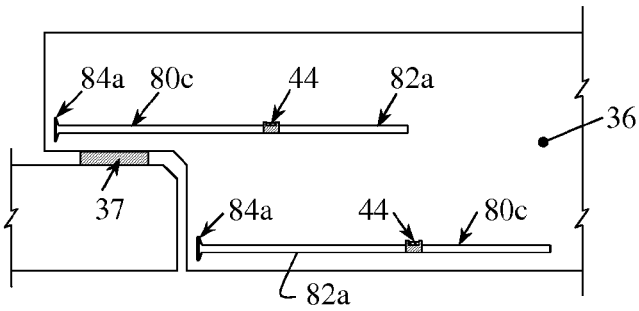

FIG. 15 shows the same type of beam as in FIG. 14, but two rows of the stud support system 40 are employed to horizontally support studs 80*c* having a head 84*a* at only one end of each stem 82*a*. The heads are located adjacent the ends of the beam in areas where crack formation is expected. Each rail 44 extends horizontally to support one or more spaced studs 80*c*.

Figure 16:
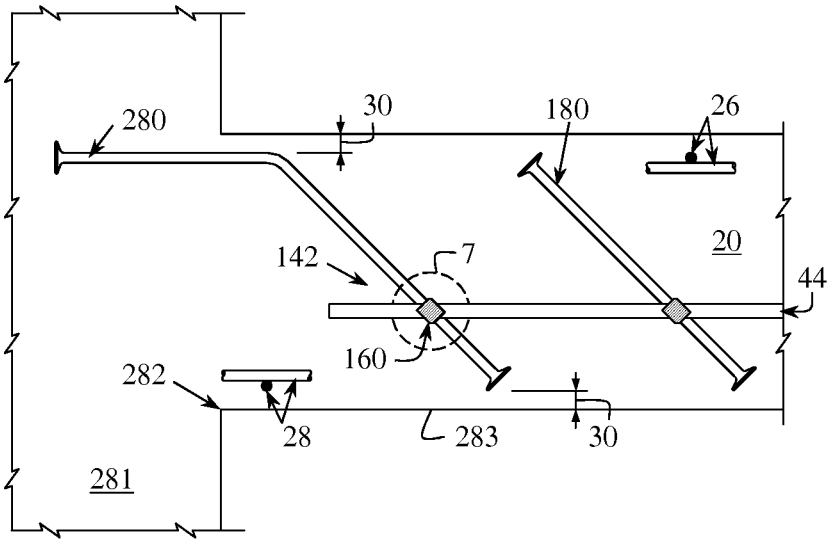

FIG. 16 shows an embodiment of the invention in the same type of concrete member 20 as in FIG. 6, but the support apparatus 142 supports stud(s) 280 bent and anchored inside a column or a wall 281 to intercept and control the widening of vertical or inclined cracks that typically start at the top face of the member 20 and extend towards the connection 282 of the bottom face 283 with the column or wall 281.

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below. For instance, in one variant it may be possible to integrally form the rail 44 with the connectors 60 of the FIG. 3 embodiment, although this is not preferred due to possible manufacturing constraints or complexities.

We claim:

1. A reinforcing assembly for a structural concrete member comprising:

shear studs each having an elongate stem with opposed free ends and an anchor head at least at one of said ends; and a support apparatus for positioning said studs in said concrete member in at least three degrees of freedom, said apparatus having:

a) an elongate rail; and b) connectors which serve to secure said stems individually to said rail, each of said connectors having:

i) a first portion forming a slot slidably mountable onto said rail so that spacing between said connectors along said rail may be chosen as desired; and, ii) a second portion having opposed arms forming a channel for press fitting said stem thereinto, said arms engaging and holding said stem and, with sufficient force, allowing removal or axial adjustment of said stem relative to said rail;

wherein said first portion is oriented relative to said second portion to position said stem relative to said rail in any one of perpendicular and non-perpendicular incline, so that all studs on said rail may be selected to be oriented between perpendicular to said rail, non-perpedicular incline to said rail, and a combination of both perpendicular and non-perpendicular incline to said rail.

* * * * *